US005131151A

United States Patent [19]

Agase et al.

[11] Patent Number: 5,131,151

[45] Date of Patent: Jul. 21, 1992

[54] CHILDREN'S SANITARY STRAP

[76] Inventors: Eric B. Agase; Cathleen A. Agase, both of 19456 Hoag Ct., Mundelein, Ill. 60060

[21] Appl. No.: 752,182

[22] Filed: Aug. 23, 1991

Related U.S. Application Data

[63] Continuation-in-part of Ser. No. 543,482, Jun. 26, 1990, abandoned.

[51] Int. Cl.[5] ..... A47J 43/28

[52] U.S. Cl. ..... 30/327; 30/298

[58] Field of Search ..... 30/324-328, 30/322, 323, 142, 147-150, 296.1, 298, 298.4, 232; 24/115 R, 115 H, 115 K, 136 R; 224/218.2; 248/693

[56] References Cited

U.S. PATENT DOCUMENTS

| | | | |
|---|---|---|---|
| D. 161,359 | 12/1950 | Milne | 30/324 X |
| D. 167,623 | 9/1952 | Eve | 30/324 X |
| 309,437 | 12/1884 | Calef | 30/324 |
| 3,397,026 | 8/1968 | Spina | 24/115 H |

*Primary Examiner*—Douglas D. Watts

*Attorney, Agent, or Firm*—Malin, Haley, McHale, DiMaggio & Crosby

[57] ABSTRACT

A children's sanitary strap to assist in eating and preventing unsanitary conditions by maintaining eating utensils within close proximity of a child's hand. The invention is a strap that couples to the child's wrist, clothing, or high chair while the opposite end of the strap is coupled to an eating utensil. The utensil is used in the customary fashion, however, if the child is unable to hold the utensil at any time causing the utensil to drop, the sanitary strap of the instant invention prevents the utensil from falling to an unclean area or beyond the reach of the child.

9 Claims, 1 Drawing Sheet

Fig. 1
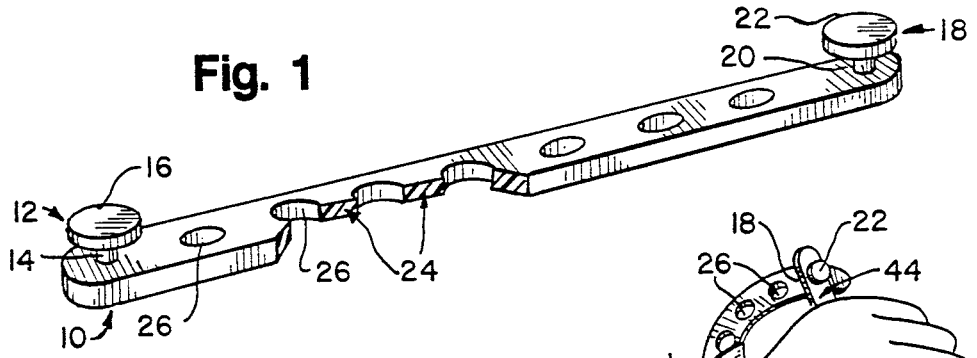
Fig. 3
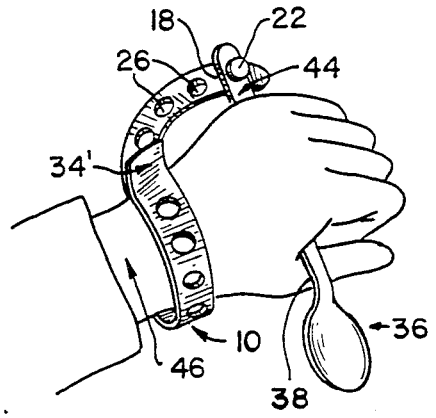
Fig. 2
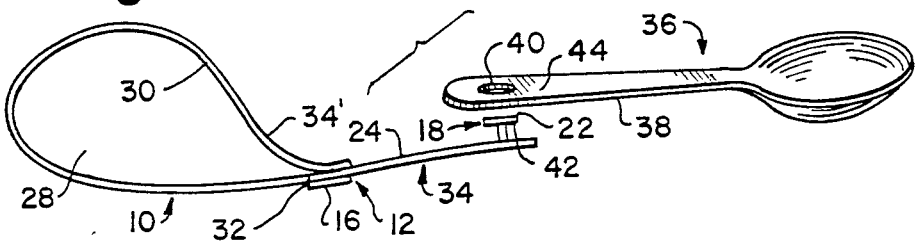
Fig. 4
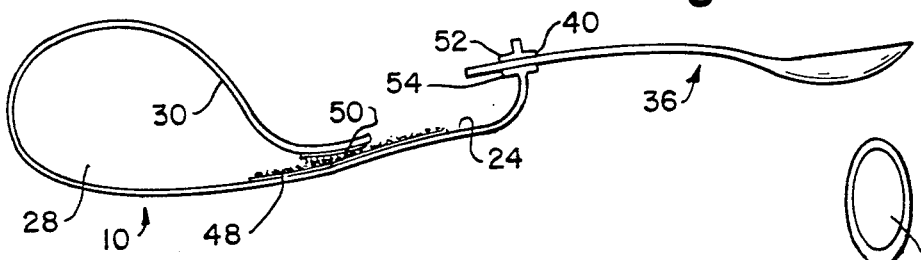
Fig. 5
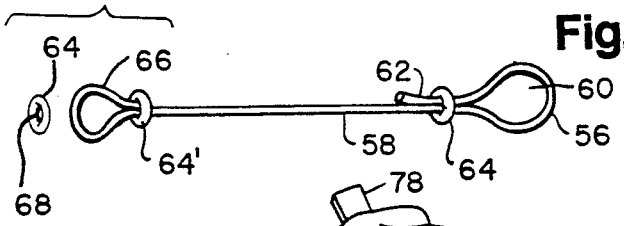
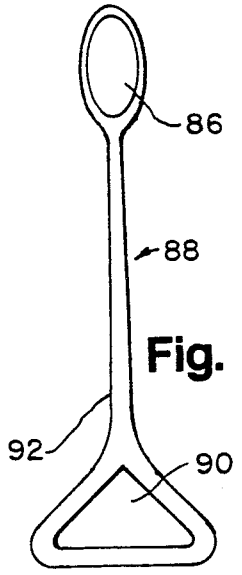
Fig. 7
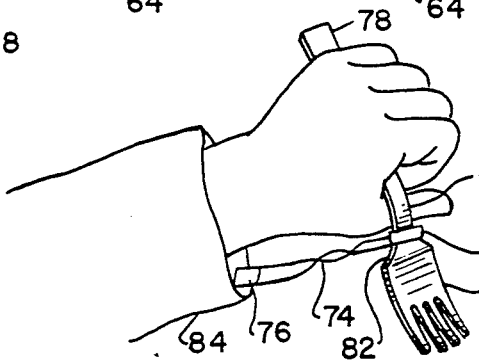
Fig. 6

CHILDREN'S SANITARY STRAP

This application is a continuation-in-part of application Ser. No. 07/543,482, filed June 26, 1990, abandoned.

BACKGROUND OF THE INVENTION

The present invention relates to an apparatus or device for preventing small children from dropping or swallowing cutlery. More particularly, the invention is directed to a device that secures cutlery, broadly termed eating utensils, to a child's wrist or high chair. Once the device is properly installed if a child accidentally drops a utensil secured by the instant invention, the device, hereinafter referred to as the sanitary strap, prevents the utensil from falling but a few inches from the grasp of the child.

Heretofore, it has been the practice of parents to teach young children to eat with their fingers until their hands are large enough to grasp eating utensils used by adults. Children unable to grasp the significance of holding a utensil results in the utensil dropping to the floor. The common reaction of a parent or guardian is to simply pick up the utensil and return it to the child's hand. Such action not only disrupts the normal eating process but leads to unsanitary conditions for the child.

In restaurants, a problem with small children arises that restaurant patrons are familiar with, that is, the sound of utensils dropping to the floor creating the same situation as above. Restaurants utilizing carpeting must quickly clean the spill to further prevent unsanitary conditions and staining of the carpet.

A further problem is the use of eating utensils that are purchased to fit the hand of a young child. Children's use of utensils that conform to the size of their hand must still be taught the skill of holding on to the utensil throughout the eating process. Such utensils may become difficult for a child to grasp if the handle becomes slick with food. Due to the small size of such a utensil and close proximity to a child's mouth, it may be swallowed causing choking, aspiration or ingestion injuries.

The problems described are those which have long plagued adults training young children to eat by utensils. While extensive efforts have been made toward effectively and simply resolving this problem, no satisfactory solution has heretofore been provided. It is, therefore, to the effective resolution of this problem that the present invention is directed.

SUMMARY OF THE INVENTION

It is the principal feature of the present invention to provide a method of preventing the displacement of a child's eating utensil by securing the utensil to a sanitary strap that in turn is secured to a child's wrist or high chair. A relatively simple but highly effective configuration and construction allows simple coupling to the utensil and wrist or high chair with sufficient clasping strength to prevent the loss of the utensil.

It is an important feature of the present invention that the sanitary strap provide ease of access allowing a child to retrieve a coupled utensil without assistance from a second party. The invention finds particular utility in the prevention of contamination resulting from utensils that are dropped to an unclean area. Parental enjoyment is furthered by not having to replace utensils or clean the floor resulting from dropped utensils during the eating process. One form of the invention is coupled to existing restaurant utensils thereby preventing the use of specially designed utensils. By use of the sanitary strap parents are able to take their children to restaurants at an early age without causing the child to revert to hand feeding or being fed by the parent.

In accordance with the practice of the invention, an eating utensil is coupled to one end of the sanitary attachment strap while the opposite end of the sanitary attachment strap is coupled to the child's wrist or high chair or an area close to the wrist or high chair such as the hand, fingers, or shirt sleeve.

In a preferred embodiment of the invention, the device features a band that wraps around a child's wrist utilizing a clasping member at one end of the band that couples to the band forming a cavity preventing the band from falling off or sliding over the child's hand. The invention also allows the band to couple to a child's shirt sleeve or high chair in place of the child's wrist. The opposite end of the band is then coupled to an eating utensil by a second clasping member securely fastening the utensil to the band and thus to the child's wrist, shirt sleeve, or high chair.

It is a related feature of the sanitary strap of the instant invention that the utensil coupled to the second clasping member can be removed for cleaning or exchanged for another utensil without removal of the sanitary strap from the child's wrist or high chair.

Another related feature of the sanitary strap is the clasping members adjustability to the wrist of any child or high chair support allowing for a range of utility without the necessity of a larger strap.

Still another feature of the sanitary strap is the ability to refine a strap to look like a bracelet or identification band while encompassing the present invention's ability to couple to a utensil.

In yet another embodiment of the invention, the utensil, handle to the utensil, and wrist or high chair coupling, can be formed from a continuous unitary piece of material so that the material forms a utensil and a band connects to the utensil in the shape of an elongated handle that ends in a hole within the handle fitting over the wrist of a child. It should be noted that the utensil is not limited to a spoon but includes those utensils or cutlery commonly referred to as knifes and forks.

Another object of the invention is its ability to use a clasping member consisting of reusable tape or velcro strips for securing the strap around the child's wrist or high chair or to a eating utensil.

Yet another object of the invention is its ability to use a clasping member consisting of a pull through plug for securing the strap around the child's wrist or high chair or to an eating utensil.

Still another object of the invention is its ability to use a clasping member consisting of a plurality of elastic bands for securing the strap around the child's wrist or high chair or to an eating utensil.

An advantage of the invention is its ability to use a combination of clasping members at either end of the band for coupling between the child's wrist, high chair, or utensil.

Another object of the invention is attachment of one end of the sanitary strap to the child's shirt sleeve by use of a conventional mitten clamp.

Still another object of the invention is attachment of the sanitary strap to a metallic utensil by use of a magnet or snap connector.

Yet another advantage of the invention is its ability to allow a child to use his hands without interference from the device for such other matters such as drinking fluid from a container.

Other and further objects, features, and advantages of the invention will become evident upon the reading of the following specification taken in conjunction with the drawing.

BRIEF DESCRIPTION OF THE DRAWINGS

The invention will be more readily understood with reference to the accompanying drawings, wherein:

FIG. 1 is a perspective view showing the sanitary strap with tab and lock hole connectors;

FIG. 2 is a perspective view showing the sanitary strap in a closed position and a utensil separated from the strap;

FIG. 3 is a perspective view showing the sanitary strap secured to a eating utensil and a child's wrist;

FIG. 4 is a perspective view showing a variation of the sanitary strap by use of an insertable plug to a utensil and the use of reusable tape for securing a cavity;

FIG. 5 is a perspective view showing a variation of the sanitary strap by use of an elastic band with hollow bead adjustment;

FIG. 6 is a perspective view showing a variation of the sanitary strap by use of an elastic fastener to a utensil and the use of a clothing fastener to secure the strap to a child's shirt sleeve;

FIG. 7 is a perspective view showing a single piece sanitary strap, handle, and eating utensil.

FIG. 8 is a perspective view showing a variation of the sanitary strap permanently coupled to an eating utensil.

FIG. 9 is a side view illustrating a releasable coupling means of FIG. 8.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure. The aims and objects of the invention are accomplished by providing a device that prevents an eating utensil used by a child from reaching the unsanitary conditions of a floor.

Referring to the drawings in more detail, and more particularly to FIG. 1, there is shown a preferred embodiment of the invention provided for illustrative purpose and not to be construed in any limiting sense. The reference numeral 10 indicates the band for our apparatus or device for the present invention for securing an eating utensil to a child's wrist. The band being comprised of plastic having a width in the range of 0.125 inches to 0.500 inches and a length in the range of 8 inches to 16 inches. Other embodiments could use, but are not limited to, material in place of plastic such as extruded rubber, bimetallic, thermal plastic, cloth, or a combination thereof.

The device depicted employs a tab and lock hole type connector shown as clasping member 12 consisting of a stem 14 projecting from the surface of the band and a cap 16 on the end of the stem formed slightly larger than the stem. The cap's top 16 and bottom surfaces is on the same plane as the band. A second clasping member 18 is placed at the opposite end of the band on the same surface of the first clasping member and consists of a stem 20 projecting from the surface of the band and a cap 22 on the end of the stem with its top and bottom surfaces on the same plane as the band. Both clasping members are positioned on the top surface 24 of the strap providing the ends of the strap with an identical profile. Each stem to the clasping member ranges from 0.0156 inches to 0.0937 inches in diameter and from 0.0125 inches to 0.25 inches in height. The diameter of the clasping member cap ranges from 0.0625 inches to 0.125 inches. Between the clasping members is a plurality of coupling holes 26 with a slightly larger diameter than the clasping member stems 14, 18 and a smaller diameter than the clasping members cap 16, 22. The height of the stem is directly related to the width of the band. The use of the cap, stem and coupling hole connector is referred to as a tab and lock hole connector.

Referring to FIG. 2, the use of the sanitary strap requires one of the clasping members, in this illustration clasping member 12, to be looped in a manner forming a cavity 28 in which a child's wrist would be placed and a cavity surface 30 of which a child's wrist rests against. Insertion of the tab 12 through a coupling hole, shown by hidden lines in FIG. 2, deforms the top of the tab's cap until the lower surface 32 of the cap 16 is flush against the bottom surface 34 of the band 10 thereby firmly securing and detachinably connecting the cavity surface 30 that immediately surrounds the tab 12 against the top surface 24. The type of material used for tab construction depicts the actual size of the cap in relation to the coupling holes. The object of the cap is to allow sufficient deformation during insertion into a coupling hole while providing sufficient resilience to return the cap to its original shape thus allowing the cap to function as a locking mechanism when used to couple two items together.

It should be noted that the versatility of the strap design allows complete adjustability in that the band can fit the wrist of any size child by insertion of the clasping member 12 into an appropriate coupling hole 26. The cavity size is dependent upon the requirements of an individual child and can be increased in size by insertion of the clasping member 12 in a coupling hole closer to clasping member 18. Conversely the size of the cavity can be reduced by placement of the clasping member 12 in a coupling hole further from clasping member 18. An eating utensil, depicted by a spoon 36 in FIG. 2, consists of a handle 38 with a coupling hole 40 placed in the handle. The utensil is securely detachinably connected providing a flexible connection to the strap by insertion of the clasping member 18 through the coupling hole 40 until the cap 22 protrudes through the coupling hole 40 causing the lower side of the cap 42 to reside flush against the handle surface 44. The use of a clasping member allows ease of utensil removal for cleaning or exchange for another utensil without removal of the sanitary strap.

In order to effect disassemble of the utensil from the band, the assembly steps must be reversed. To this end, the clasp member 18 is pulled out of the coupling hole 40 of the handle 44 by means of pushing or pulling the cap 22 through the coupling hole 40 forcing the cap's lower surface 42 against the surface of the handle 44 until the cap is sufficiently deformed to fit through the coupling hole 40 thereby releasing the utensil from the band.

In a similar fashion to effect disassembly of the sanitary strap from its formation of a cavity, the assembly steps must be reversed. To this end, the clasp member 12 is pulled out of the coupling hole 26 of the band 10 by means of pulling the cap 16 through the coupling hole 26 forcing the cap's lower surface 32 against the lower surface of the band 34 until the cap is sufficiently deformed to fit through the coupling hole 26 thereby releasing the band from its cavity forming position.

In order to better illustrate the installed position of the sanitary strap of the present invention FIG. 3 shows the band 10 wrapped around a child's wrist 46 with the bottom surface 34' of the band covering a clasping member. The top 22 of the second clasping member 18 can be seen protruding through the handle 38 of the utensil 36 resting against the surface 44. If the child released his grip on the utensil 36 the handle's attachment to the band 10 by means of the clasping member 18 would prevent the spoon from traveling but a short distance. The device allows the coupled utensil to rotate 360 degree around the clasping member 18 and the flexibility of the sanitary strap as provided by the type of material and the size of the unused coupling hole, allows comfortable bends between clasping members 12 and 18 while the device is installed.

Shown in FIGS. 4–7 are modified forms of my invention wherein a children's sanitary strap apparatus or device for securing a eating utensil to a child's wrist is illustrated. These variation can be manufactured from the same materials as previously described and used in much the same way except for the manner of assembly and disassembly of the device.

FIG. 4 is a variation of the clasping member employing the use of reusable tape such as Velcro tape. Velcro tape comprises cooperating surfaces facing each other with one said surface carrying a plurality of small hook like male members and the other said surface carrying a felt-like material referred to as the female member. The female portion of velcro tape 48 is permanently affixed to band surface 24 and clasps to the male portion of velcro tape 50 which is permanently affixed to band surface 24 in the open position or surface 30 as shown in FIG. 4 upon creation of cavity 28 with the band.

The use of the sanitary strap requires one of the male clasping member 50 to be looped in a manner forming a cavity 28 in which a child's wrist would be placed and a cavity surface 30 of which a child's wrist rests against. Depression of the male clasping member 50 against the female clasping member 48 firmly securing the cavity surfaces 30 against the top surface 24. It should be realized that the female clasping member 48 is of sufficient length allowing full adjustability in that the clasping member can fit the wrist of any size child without the need to exchange for a larger strap. The cavity size is dependent upon the requirements of an individual child and can be increased in size by positioning of the male clasping member 50 toward clasping member 52 before securing to female clasping tape 48. Conversely the size of the cavity 28 can be reduced by positioning of the male clasping member 50 toward the cavity thereby reducing the size of the cavity 28 before securing to female clasping member 48.

An eating utensil, depicted by a spoon 36 with a coupling hole 40 placed in the handle is similar to that shown in FIG. 2–3. The opposite end of the band is similar in function to clasp members of FIG. 1–3 except the clasp member is simplified by forming the band out of a circular shape and providing a top locking member 52 and a bottom locking member 54. The utensil is securely fastened to the strap by insertion of the top locking member 52 through the coupling hole 40 trapping the two sides of the coupling hole between locking members 52, 54. The use of a clasping member allows the utensil to be removed and cleaned or exchanged for another utensil without removal of the sanitary strap.

In order to effect disassembly of the utensil from the band, the assembly steps must be reversed. To this end, the top locking member 52 is pulled out of the coupling hole 40 of the utensil 36 by means of pushing or pulling the top locking member 52 through the coupling hole 40 . until sufficiently deformed to fit through the coupling hole 40 thereby releasing the utensil from the band.

In a similar fashion to effect disassembly of the band 10 from its formation of a cavity 28, the assembly steps must be reversed. To this end, the male clasp member 50 is pulled away from the female clasp member 48 thereby releasing the band from its cavity forming position.

Now referring to FIG. 5, another variation of the invention is shown for use when a child is situated in a high chair and using conventional eating utensils. The portion of the invention that straps to a conventional eating utensil employs the use of an elastic material, such as rubber or cloth reinforced rubber, that releasably secured around the utensil's handle. In this form of our invention, requires the elastic material 56 on one end of a band 58 form a cavity 60 to be placed around a utensil, child's wrist, or high chair. The band 58 is of sufficient length so as to enable a child to use a utensil in its ordinary manner when it is attached to the band at one end while the second end of the ban is attached to a child's wrist or high chair. The cavity 60 is then decreased in size by first placing the end of the material 62 through a bead 64. By holding the band 58 and the end of the material 62, the hollow bead 64 is slid toward the cavity by pulling the material through bead opening 68 thereby decreases the size of the cavity 66. The bead 64 is made out of a material such as plastic that allows the band 58 to slide within the hollow section 68 of the bead but provides sufficient friction to prevent the loosening of the bead without the assistance of a third person.

The strap may also be created by a preformed piece of material, referring to FIG. 5., where a cavity 66 is permanently formed out of single piece of material where one end of the strap terminates in a closed end allowing the simplified use of a bead 64' to decrease the size of the cavity without the necessity of feeding an end of the material through a bead. The bead 64' is slid toward the cavity 66 to by pushing or pulling the material 58 through the opening 68 of the bead thereby decreasing the size of the cavity 66. In order to effect disassembly of the utensil from the band requires the hollow bead 64 and 64' to slide away from the cavity opening.

It should be understood that for the loop depicted by end material 56 can be placed through the cavity 66 forming a third cavity for placement around larger objects such as the arm of a high chair.

Now referring to FIG. 6, another variation the invention is shown for use when a child uses conventional utensils but does not use a high chair or similar support. The portion of the invention that straps to a conventional eating utensil employs the use of an elastic material that wraps around a utensil's handle for securing the utensil. In this form of our invention, the use of elastic material clasping member 56 is not adjustable and wraps around a utensil's handle permitting the apparatus or device to be used on conventional utensils 58 such as those commonly found in restaurants. The variation of the strap shown is a piece of flexible material 74, such as reinforced cloth with elastic rubber, attached to the elastic material clasping member 70 at one end and a conventional child's mitten clasping member 76 at the opposite end. A child's mitten clasp is described as cooperating surfaces facing each other with each surface carrying a plurality of small angular protrusions or teeth which engage with a cloth material releasably securing the cloth between the two surfaces as the teeth grasp the cloth.

The use of the sanitary strap requires the elastic material clasping member 70 to slide over the end of the utensil 78, across the length of the handle 80 to the neck 82 area or any pronounced widening of the handle. The sanitary strap is coupled to the shirt sleeve 84 of a child by clamping the mitten clasp member 76 to a convenient section of the sleeve.

In order to effect disassembly of the utensil 72 from the strap 74 requires the elastic material clasping member 70 to be slid away from the neck 82 across the length of the handle 80 and over the end 78 of the utensil.

In a similar fashion to effect disassembly of the band 74 from the shirt sleeve 84, the assembly steps must be reversed. To this end, the mitten clasp member 76 is unclamped.

It will be obvious to those skilled in the art that various changes may be made without departing from the scope of the invention including but not limited to the use of identical clasp members at either end of the child's sanitary strap.

FIG. 7 is a single piece item whereby the utensil, such as a spoon, is formed from a continuous piece of material whereby a utensil is formed out of one end of the material and a cavity at the opposite end. In this form of my invention, the use of tool 86 section of the device is permanently adjoined to the handle 88 which ends in a cavity 90 at the opposite end of the tool.

The use of the sanitary strap requires the cavity 90 to slid over a child's hand to the wrist area. The lower section of the handle 92 is flexible enough to permit deformation of handle section to conform to the child's nature grasp. The majority of the handle 88 is stiffer permitting the tool to be used as a regular utensil. Shown in FIG. 8 is another form of my invention wherein one-piece band 94 is of elongated flexible material having uniform diameter. Band 94 has a first free end 96 and a second opposite free end 98. First free end 96 is slidably coupled tot he body of said band 94 at a predetermined distance from said second free end 98 by use of clamp 100 forming an adjustable loop 102 having a cavity 104 formed within having a inner diameter between 1 inches and 4 inches. Clamp 100 can be made from plastic, metal, or like means capable of securely coupling free end 96 to the band 94.

Utensil 106 is comprised of a conventional tool section 108 and a handle 110. The handle 110 has a means for encompassing the diameter of the band 94 by sue of eye-hook 112, or a like opening, formed into the handle 110 of said utensil 106. The second free end 98 is placed through the opening 114 of eye hook 112 and is slidably coupled to body of band 94 a predetermined distance from the first free end 96 by use of a clamp 116 forming a permanent loop 118 therein. Alternatively, the eyehook 112 can be made detached requiring an insertable hole 120 in handle 110 wherein eyehook 112, shown separately in FIG. 9, is a single piece of molded flexible material such as plastic for insertion into said insertable hole 120 forming an inner opening 114, and further having a pair of lock pawl projections 126 extending obliquely from opposite sides of the eyehook 112 from angular insertion points 124.

Installation is by placement of loop 118 within eyehook opening 114 and insertion of insertion points 124 into insertable hole 120. Said lock pawl projections 126 being disposed through said insertable hole 120 engaging the sides of the insertable hole and bearing resiliently against a lower surface 130 of said handle.

Placement of the child's hand through the adjustable loop 102 or placement of the band 94 across a child's high chair support or wrist and insertion of the utensil through cavity 104 formed by first end 102 thereby securing a child's eating utensil while permitting use in its ordinary and conventional manner.

It will be apparent that modifications in accordance with the present invention can be made by those skilled in the art without departing from the spirit thereof and it is equally apparent that the assembly involving the application of utensil and attachment strap may be rearranged in order to accomplish this assembly without departing from the scope of the invention. This includes the employment of clasping members in combinations other than those described and illustrated by the drawings.

It will be obvious to those skilled in the art that various changes may be made without departing from the scope of the invention and the invention is not to be considered limited to what is shown in the drawings and described in the specification.

What we claim as new and desire to secure by Letters Patent of the United States is:

1. A children's sanitary device for securing an eating utensil to a child's wrist comprising:

a utensil having two sides and a free coupling hole within;

a band of flexible material having top and bottom surfaces and first and second opposite ends, said band having a plurality of free coupling holes disposed between said first and second end; and said band having an insertable first clasp member disposed near the first end extending obliquely from the top surface for coupling the top surface with the first end by insertion of said first clasp member in a free coupling hole of said band thereby forming a cavity encompassed by the top surface for placement around a child's wrist, said band having an insertable second clasp member disposed near the second end of said band extending obliquely from the top surface for coupling the second end of said band with the utensil by insertion of said second clasp member in said free coupling hole of said utensil permitting a flexibly connected coupling.

2. The child's sanitary strap according to claim 1, said band characterized by a single piece of plastic material having a length of 8 inches to 16 inches.

3. The child's sanitary strap according to claim 2, said band having a width of 0.125 inches to 0.500 inches.

4. The clasp member according to claim 1 further characterized by a stem and cap.

5. The stem according to claim 4 further characterized by a diameter of 0.0156 inches to 0.0937 inches and a height of 0.0125 inches to 0.25 inches.

6. The cap according to claim 4 further characterized by a diameter of 0.0625 inches to 0.125 inches.

7. The child's sanitary strap device according to claim 1, wherein said second clasping member of said second end of said band has an identical profile to said first clasp member of said first end of said band.

8. A children's sanitary device for securing a child's eating utensil to a child's high chair support or wrist comprising: a one-piece band of elongated flexible material of uniform diameter having first and second opposite free ends, said first free end slidably coupled to said band by a first clamp forming a first adjustable loop, said second free end slidably coupled to said band by a second clamp forming a second adjustable loop therein; a utensil comprised of a conventional tool section and a handle; and a means for coupling said handle to said second adjustable loop; whereby placement of a child's hand through said first loop made adjustable by slidably movement of said first clamp causing said first loop to tighten around the child's wrist or placement of the band across a child's high chair support and insertion of said second loop through said first loop secures the band preventing loss wherein coupling said utensil to said second loop permits use of the utensil in its ordinary and conventional manner.

9. The children's sanitary device according to claim 8 wherein said means for coupling said handle to said second adjustable loop comprises an eye hook operatively associated with said handle.

* * * * *